United States Patent [19]

Lascelles et al.

[11] 4,339,638

[45] Jul. 13, 1982

[54] ELECTRICAL SWITCH

[75] Inventors: Daniel J. Lascelles, Deland, Fla.; Jack M. Walker, Meggen, Switzerland

[73] Assignee: McDonnell Douglas Corporation, St. Louis, Mo.

[21] Appl. No.: 197,199

[22] Filed: Oct. 15, 1980

[51] Int. Cl.[3] ..... H01H 39/00; F42C 19/06; H01H 1/00; H01R 4/10

[52] U.S. Cl. ..... 200/52 R; 102/216; 102/262; 200/61.08; 200/51 R; 200/82 R; 200/83 R; 200/238; 337/412; 339/19

[58] Field of Search ..... 200/329, 300, 82 R, 200/82 C, 51.12, 51.13, 16 R, 16 A, 16 B, 52 R, 61.08, 61.53, 61.19, 153 M, 51 R, 243, 237, 238; 102/216, 262-264; 339/19; 174/94 R; 337/406, 412, 413, 416

[56] References Cited

U.S. PATENT DOCUMENTS

| | | | |
|---|---|---|---|
| Re. 26,685 | 10/1969 | Broske | 174/94 R |
| 769,824 | 9/1904 | Hopkinson | 337/412 |
| 1,199,654 | 9/1916 | Bailey | 337/412 |
| 2,419,828 | 4/1947 | Ferris | 102/262 X |
| 2,712,575 | 7/1955 | Kiel | 200/52 R |
| 2,712,791 | 7/1955 | Bleakney et al. | 102/262 |
| 2,721,240 | 10/1955 | Filbert | 200/83 R |
| 2,888,538 | 5/1959 | Jensen | 337/406 |
| 2,920,166 | 1/1960 | Geballe | 337/413 |
| 3,049,601 | 8/1962 | Hardesty | 200/61.08 X |
| 3,180,957 | 4/1965 | Chumakov | 337/413 |
| 3,793,501 | 2/1974 | Stonestrom | 200/61.08 |
| 4,007,796 | 2/1977 | Boop | 200/61.08 X |

*Primary Examiner*—James R. Scott

*Attorney, Agent, or Firm*—Gravely, Lieder & Woodruff

[57] ABSTRACT

An electrical switch includes a body having one open end exposed for adaptation of a pyrotechnic cartridge and the other end sealed by the base of a pin type connector assembly having short conductive pins and elongated conductive pins with relief areas containing insulative material. The pins are inserted into the body cavity. A conductive grounding plate or plates have tabs which bite into the pins and connect selected pins in a first operational state. A plunger having fracturable bosses is located adjacent the contact plate. Upon activation of a pyrotechnic cartridge, pressure is applied to the plunger, causing fracture of the bosses and resulting in the displacement of the plunger to move the contact plate to a different position thereby changing the number of closed circuits.

16 Claims, 10 Drawing Figures

ELECTRICAL SWITCH

The government of the United States of America has rights in this invention pursuant to Contract No. F33657-77-C-0200 awarded by the Department of the Air Force.

BACKGROUND OF THE INVENTION

This invention relates in general to electrical switches, and more particularly to a switch which upon being actuated establishes positive contact.

Aircrafts have a wide variety of electrical switches, one type requiring the detonation of an explosive to change its condition. These switches are often employed in emergency escape systems, for they provide a quick and positive means for opening doors or ejecting personnel. The typical explosive-operated switch includes a body into which the explosive discharges, and this body contains a piston which is normally held in a fixed position by a single shear pin. However, when the explosive is detonated, the force generated by it shears the pin and drives the piston through the body. The piston in turn causes a slide to change position within the body. Both the body and the slide have contacts embedded within them, and the change in position for the slide results in a different alignment of contacts between the body and slide. The body also has a standard pin-type connector on it, with the pins of the connector being connected to the contacts of the body by wires that are soldered to their respective pins and contacts.

The typical switch is not altogether satisfactory for aircraft or other applications. First, its assembly requires a considerable amount of manual labor inasmuch as the wires between the pins and the contacts of the body must be placed and soldered or otherwise secured by hand. Secondly, the wires themselves present operational problems in that they are subject to fatigue and hence breakage, they may not be adequately secured, or they may lose their insulation. The wires also require an access opening in the switch body, and this opening is usually closed by a cover plate that is welded in place. As a consequence the switch cannot be taken apart for inspection. Aside from that, the shear pin tends to cause the slide to skew initially in the chamber, and this in turn can cause contact bounce with its attendant voltage fluctuations. Furthermore, the switch has no locking feature, but instead relies on friction between the slide and body to hold it in its actuated condition, which is not an entirely reliable arrangement. In addition, the aligned contacts on the slide and body normally establish electrical contact at only one location, or point, along their opposing surfaces.

SUMMARY OF THE INVENTION

One of the principal objects of the present invention is to provide a switch that is operated by an explosive detonation or for that matter just about any other type of linearly directed force, and when so actuated positively locks into the actuated condition. Another object is to provide a switch of the type stated that is easily assembled, and indeed lends itself to machine assembly. A further object is to provide a switch of the type stated that has no internal wiring and thereby eliminates all of the problems attendant with wiring. An additional object is to provide a switch of the type stated which changes condition without "bounce" so that no fluctuations of any significance are introduced into the electrical circuit when the switch is actuated. Still another object is to provide a switch of the type stated in which each pair of aligned contactors establishes electrical contact at a plurality of locations. Yet another object is to provide a switch of the type stated which can assume a wide variety of configurations including the double pole-double throw configuration. These and other objects and advantages will become apparent hereinafter.

The present invention is embodied in a switch having a body, parallel pins mounted on the body with the pins being electrically conductive, a dielectric member also mounted on the body and containing holes with which the pins align, and an electrically conductive contact plate mounted on the dielectric member and having apertures that align with the holes and are configured to receive the pins and grip them tightly when they are so received. The relative positions of the dielectric member and the pins are capable of being changed along the axes of the pins. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
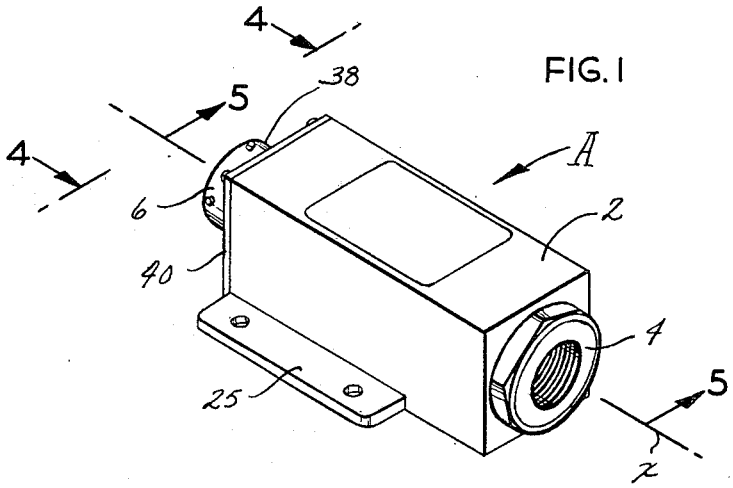
FIG. 1 is a perspective view of an electrical switch constructed in accordance with and embodying the present invention.

Referring now to the drawings, an electrical switch A (FIG. 1) is activated by an explosive charge or some other suitable force and when actuated changes the condition of an electrical circuit without any significant voltage fluctuations or bounce. Furthermore, the switch A locks in the actuated condition and cannot be dislodged for that condition by even the severest of impacts. Basically, the switch A includes (FIG. 2) a body 2, an end fitting 4 at one end of the body 2, and a pin-type connector 6 at the other end of the body 2. In addition, it includes a piston 8, a plunger 10, and a grounding disk 12, all of which are located within the body 2 between the fitting 4 and the connector 6.

The body 2 is extruded from a suitable metal such as aluminum and thereafter is machined, all to provide it with a central bore 16 (FIG. 5), a pressure cylinder 18 at one end of the central bore 16, and a plunger cavity 20 on the other side of the central bore 16. The piston 8 fits into both the central bore 16 and the pressure cylinder 18, whereas the plunger 10 is wholly contained within the plunger cavity 20. The piston cylinder 18, in turn, opens into a threaded end bore 22 that extends all the way to the end of the body 2, and the end fitting 4 threads into the bore 22. The plunger cavity 20, on the other hand, opens into a very shallow annular recess 24 that receives a portion of the connector 6. The annular recess 24, the plunger cavity 20, the central bore 16, the pressure cylinder 18, and the end bore 22, all lie in that order from the front to the rear of the body 2 along a common axis X with which they are concentric. The body 2 at its base is provided with tabs 25 (FIG. 1) that project outwardly for mounting the switch A against a suitable surface.

Figure 5:
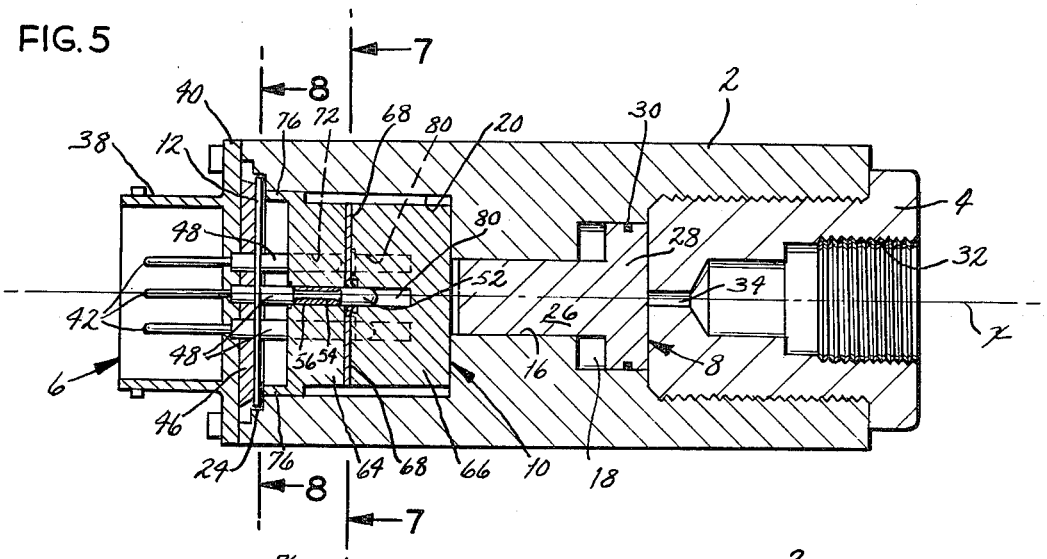
FIG. 5 is a sectional view of the switch taken along line 5—5 of FIG. 1 with the plunger illustrated in its initial position.

The piston 8 is formed from a metal such as aluminum and includes an elongated pilot 26 and shortened head 28 which is larger in diameter than the pilot 26 (FIG. 5). The pilot 26 fits into the central bore 16, but is somewhat longer than that bore 16, while the head 28 fits into the pressure cylinder 18, but is somewhat shorter than that cylinder 18. Both fit loosely enough to enable the piston 8 to shift easily along the axis X of the body 2. The arrangement is such that the piston 8 can shift from a retracted position (FIG. 5), wherein its head 28 is against the end fitting 4 and the free end of its pilot 26 is within the central bore 16, to an extended position (FIG. 6), wherein the head 28 is at the inner end of the pressure cylinder 18 and the free end of the pilot 26 projects beyond the central bore 16 into the plunger cavity 20. In this regard, the free ends of both the pilot 26 and the head 28 are squared off with respect to the axis X. The head 28 further possesses an annular groove that opens outwardly from its peripheral surface and receives an O-ring 30 that wipes the surface of the pressure cylinder 18, establishing a fluid-tight seal therewith.

The end fitting 4 threads into the end bore 22 where it forms a stop against which the squared off end face of the piston head 18 abuts, so as to retain the piston 8 within the body 2. The fitting 4 contains a threaded explosive port 32 (FIG. 5) which is capable of accommodating a conventional pyrotechnic cartridge (not shown). The port 32 opens into the pressure cylinder 18 through a small orifice 34 in the fitting 4. Thus, when the cartridge detonates, the pressure within the port 32 increases substantially, and this increase in pressure is transmitted to the pressure cylinder 18. As a consequence, the piston 8 moves abruptly from its retracted position to its extended position. Actually, the threaded port 32 may be connected to any one of a variety of devices for increasing the pressure within it, such as an air line leading to a source of compressed air or a hydraulic line leading to a hydraulic pump. Indeed, the piston 8 may be moved without fluid devices. For example, a mechanically shifted plunger, a solenoid, or an inertially operated device may be employed, with minor adaptations to the end fitting 4, to move the piston 8 from its retracted position to its extended position.

Figure 4:
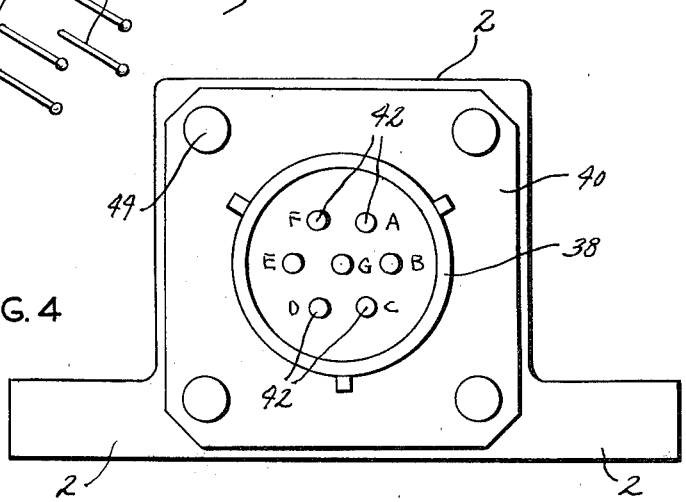
FIG. 4 is an end elevational view of the switch taken along line 4—4 of FIG. 1 and showing the pin-type connector.

Referring now to the opposite end of the body 2, the connector 6 has a standard bayonet fitting 38 that projects from a mounting plate 40 and contains the usual array of pins 42 (FIG. 4). Indeed, the configuration of the fitting 38 and the arrangement of the pins 42 within it may be that of a standard MS connector. The connector 6 fits over and closes the annular recess 24 and the plunger cavity 20 which opens into the recess 24 (FIG. 5). It is secured firmly in place by machine screws 44 which pass through the mounting plate 40 and thread into the body 2. The pins 42 are electrically isolated from each other at the plate 40, and are anchored in a dielectric disk 46 which backs the mounting plate 40 and fits into the shallow recess 24 at the end of the plunger cavity 20.

Figure 2:
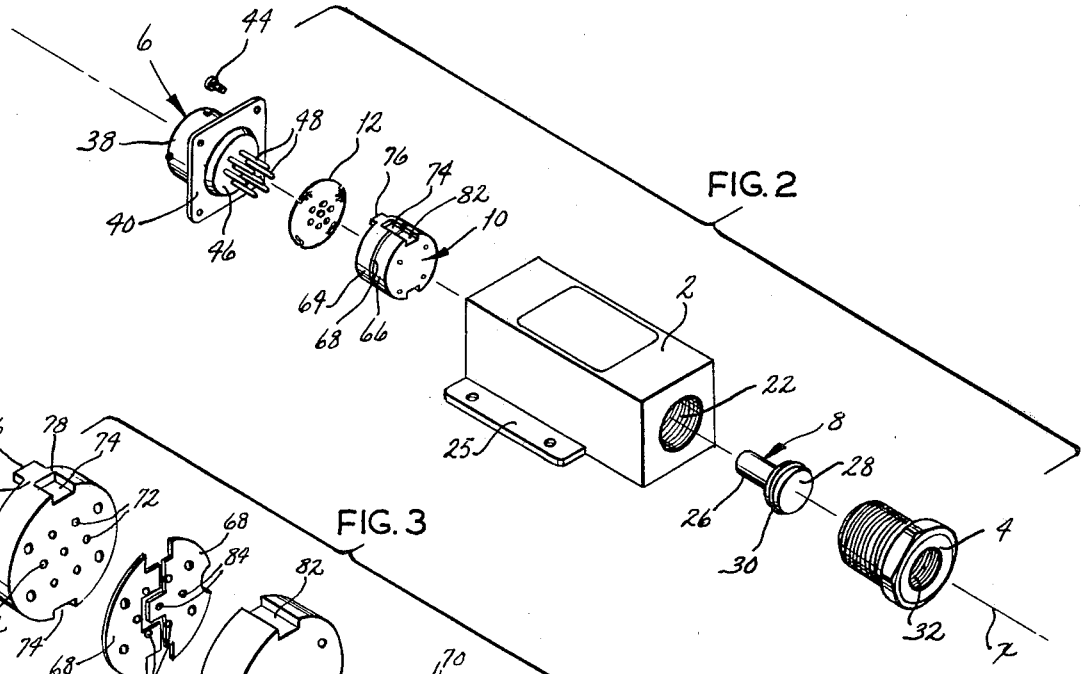
FIG. 2 is an exploded perspective view of the switch.
Figure 10:
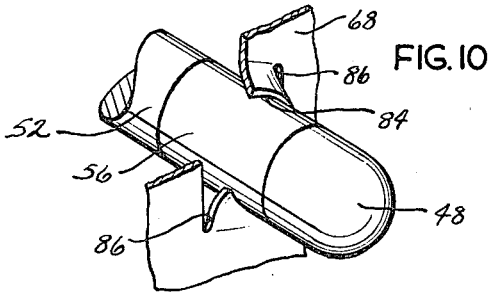
FIG. 10 is a fragmentary perspective view of a composite pin extension with the dielectric portion of that pin extension being within the aperture of the contact plate with which it aligns.

In contrast to conventional connectors where the pins are connected with wires at the back face of the mounting plate, the pins 42 of the connector 6 extend rearwardly beyond the mounting plate 40 in the form of pin extensions 48 (FIGS. 2 and 5). Indeed, not one of the pins 42 or pin extensions 48 has a wire connected to it. The pin extensions 48 extend into the plunger cavity 20, where they terminate at chamfered ends, and are arranged in that cavity in the same pattern as the pins 42, inasmuch as each extension 48 forms an axial continuation of one of the pins 42. However, the pin extensions 48 are somewhat greater in diameter than the pins 42, and each has a shoulder which is located within the end plate 40 to prevent the pin extension 48 and its pin 42 from being pushed out of the bayonet fitting 38 when an axially directed force is applied to the pin extension 48. While the pins 42 are the same length, the pin extensions 48 are not. Generally, two lengths are provided—short and long—and the particular length of any extension 48 to a large measure depends on the particular function for which the switch A is designed. Moreover, not all of the pin extensions 48 have the same external surface. In this regard, all of the short pin extensions 48 are solid metal throughout, and are preferably plated with gold. Some of the long pin extensions 48 are the same, that is solid metal plated with gold. On the other hand, some of the long pin extensions 48 are composed of both metal, which of course conducts electricity, and a dielectric which essentially does not conduct (FIG. 10). Each of these composite pin extensions 48 has a metal core 52 which at its free end is the same diameter as the solid metal pin extensions 48 (FIG. 5). However, between its ends, the core 52 has a neck or annular relief 54, so that the core 52 is reduced in diameter within this region. The relief 54 contains a collar 56 that is formed from a dielectric material, yet the collar 56 has the same outside diameter as the two ends of the core 52, so that the pin extension 48 itself maintains a uniform outside diameter from its flange 50 to its free end. One of the pins 42 is known as a grounding pin, and its pin extension 48 is considerably shorter than the remaining pin extensions 48.

Figure 8:
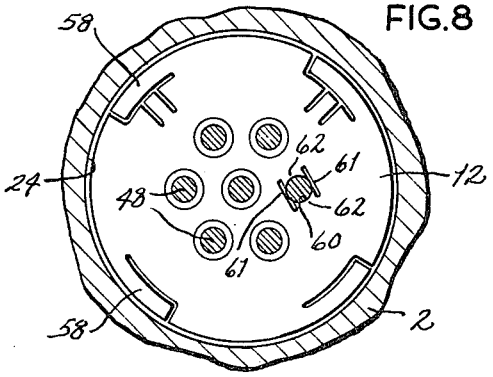
FIG. 8 is a fragmentary sectional view of the switch taken along line 8—8 of FIG. 5 and showing the grounding disk of the switch.

The grounding disk 12 which is formed from a good electrical conductor, such as beryllium copper alloy, fits against the dielectric backing disk 46 and is large enough to be received snugly within the annular recess 24 that opens out of the end of the body 2 (FIGS. 5 and 8). Moreover, along its periphery the grounding disk 12 is cut so as to provide several circumferentially directed tabs 58 which are bent rearwardly toward the body 2. Indeed, the tabs 58 contact the base of the recess 24 so as to establish good electrical contact between the disk 12 and the metal body 2. However, the center portion of the grounding disk 12 is cut away such that the disk is electrically isolated from all of the pin extensions 48, and the corresponding pins 42 as well, except the pin extension 48 that extends from the grounding pin 42. At this pin extension 48, the grounding disk 12 has a circular aperture 60 (FIG. 8) that is slightly smaller in diameter than the diameter of the grounding pin extension 48, and a pair of parallel slots 61 that are tangent to the aperture 60. The slots 61 form gripping tabs 62 at the aperture 60, so that when the disk 12 at its aperture 60 is pushed over the pin extension 48, the tabs 62 will flex slightly and allow the disk 12 to move against the dielectric backing disk 46, whereupon the tabs 62 grip the extension 48 and prevent the disk 12 from moving away from the backing disk 46. The grounding disk 12 electrically connects the grounding pin 42 with the body 2 so that the grounding pin 42 is at ground potential.

Figure 7:
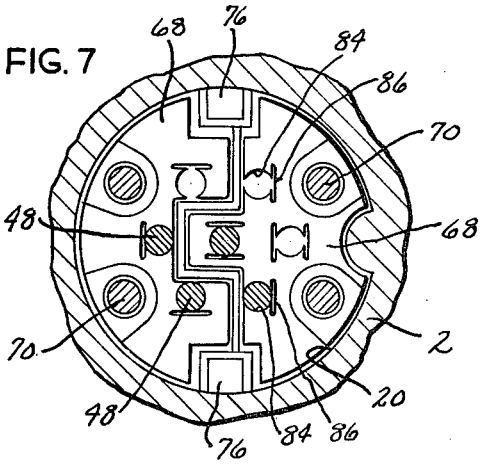
FIG. 7 is a fragmentary sectional view of the switch taken along line 7—7 of FIG. 5 and showing the contact plates of the plunger.

The plunger 10 is contained within the plunger cavity 20 with one end abutting the rear end of the cavity 20 and the other end against the grounding disk 12 at the forward end of the cavity 20 (FIG. 5). As a consequence, the plunger 10 remains firmly in position with respect to the switch body 2, even though its diameter is slightly less than the diameter of the cavity 20. The plunger 10 includes (FIG. 3) a leading disk 64 and trailing disk 66, both of which are formed from a dielectric material, and in addition metal contact plates 68 (FIG. 7) are located between the disks 64 and 66 to establish electrical contact between various combinations of pin extensions 48. The two disks 64 and 66 are held together, with the contact plates 68 interposed between them, by several axially extending rivets 70. Before the switch A is actuated the short pin extensions 48 extend only into the leading disk 64, whereas the long pin extensions 48 extend through the leading disk 64 and also through contact plates 68 as well, terminating within the trailing disk 66 (FIG. 5).

The leading disk 64 is molded from a plastic material such as glass-reinforced polyester, which has dielectric properties. It is for the most part cylindrical, having a cylindrical peripheral wall and front and back walls that are squared off with respect to the cylindrical wall. The diameter of the cylindrical wall is slightly less than the diameter of the plunger cavity 20 so that the leading disk 64, when unrestrained may shift forwardly in the cavity 20. The disk 64 contains bores 72 (FIGS. 3 and 5) which are arranged in the same pattern as the pin extensions 48 and are large enough in diameter to easily receive the pin extensions 48. Consequently, the pin extensions 48 prevent the disk 64 from turning in the cavity 20, yet do not prevent it from moving axially.

Figure 3:
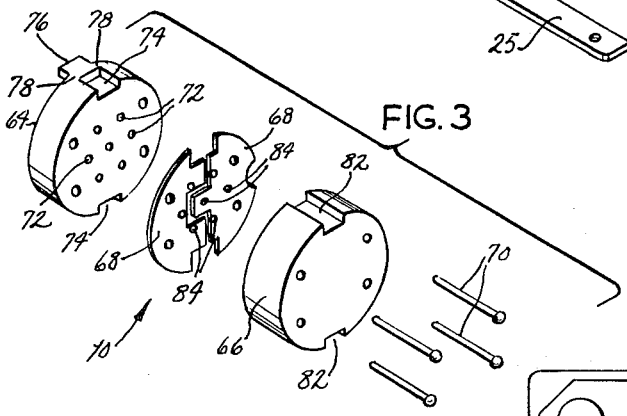
FIG. 3 is an exploded perspective view of the plunger forming part of the switch.
Figure 6:
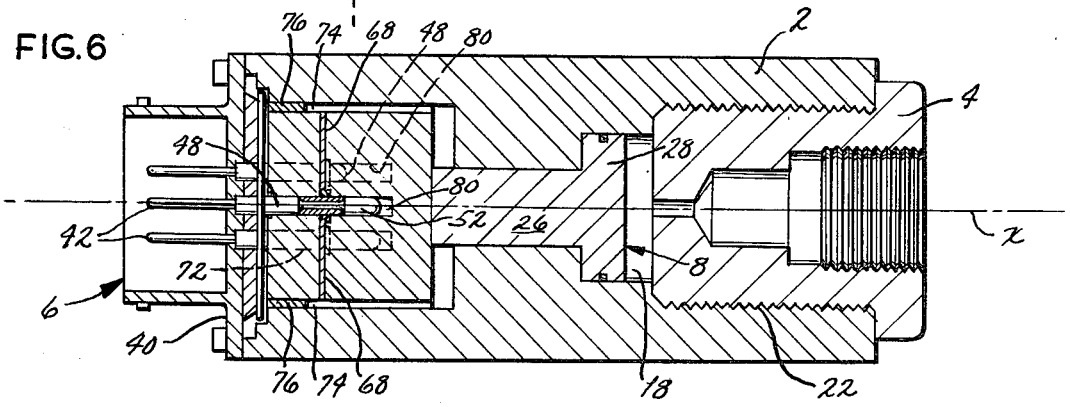
FIG. 6 is a sectional view similar to FIG. 5, but showing the plunger of the switch in its displaced position.

Opening out of the cylindrical surface of the leading disk 64 are two axially extending grooves 74 (FIGS. 3 and 5) which are arranged 180° from each other. Each groove 74 extends from the back face of the disk 64, but terminates short of the front face where it aligns with a boss 76 that projects forwardly toward the grounding disk 12. Each boss 76 is slightly smaller, both in height and width, than the groove 74 that lies behind it, and is connected to the main body of the disk 64 along regions of weakness 78 (FIG. 3). If the disk 64 is urged forwardly against the grounding disk 12 with enough force, the leading disk 64 will fracture at the regions of weakness 78, allowing the entire plunger 10 to move forwardly toward and against the grounding disk 12, while the bosses 76, which are detached at this point, are received in the grooves 74 (FIG. 6). Thus, the plunger 10 has the capability of moving from its initial position to a displaced position.

The trailing disk 66 is very similar to the leading disk 64, only it does not have the bosses 76. In particular, the trailing disk 66 has a cylindrical configuration which is the same diameter as the leading disk 64. It also has bores 80 (FIG. 5) that align with and are the same size as the bores 72 in the leading disk 64. Moreover, it has grooves 82 (FIG. 3) which align with and are the same size as the grooves 74 in the disk 64, but these grooves extend the full length of the disk 66 so as to, in effect, form continuations of the grooves 74 in the leading disk 64.

The contact plates 68 (FIGS. 5 and 7) lie between the two dielectric disks 64 and 66 and are clamped firmly in position by the rivets 70. Neither plate 68 extends out to the periphery of the disk 64 and 66 or contacts the rivets 70, so that the disks 64 and 66 electrically isolate the plates 68 from the metal switch body 2. One of the disks 64 or 66 is further relieved on its end face to provide recesses which snugly accommodate the plates 68 to separate them and thereby electrically isolate them from each other. Each contact plate 68 contains apertures 84 which align with corresponding pairs of aligned bores 72 and 80 in the leading and trailing disks 64 and 66, respectively. The diameter of each aperture 84 is slightly smaller than the diameter of the pin extension 48 which aligns with it, that is the pin extension 48 which is in the bore 72 ahead of it. Each aperture 84 is flanked by a pair of slots 86 that are parallel and tangent to the margin of the aperture 84, or by a slot 86 and a free edge of the contact plate 68. Each slot 86 extends equidistantly from the point of tangency, and that distance slightly exceeds the radius of the aperture 84. As a result, the plate 68 along each aperture 84 is divided into a pair of somewhat flexible tabs 88 (FIGS. 9 and 10) that yield within the elastic range of the metal when the pin extension 48 of the preceeding bore 72 is driven through the aperture 84. The arrangement enables the apertures 84 to accomodate the pin extension 48, even though the pin extensions 48 are somewhat larger in diameter than the apertures 84, and further permits the contact plates 68 to tightly grip each pin extension 48 at two locations along the surface of the pin extension 48. This not only serves to establish good electrical contact between the pin extensions 48 and the contact plates 68, but also holds the plunger 10 firmly in position on the pin extensions 48 in the sense that the plunger 10 cannot be extracted, that is pulled off of, the pin extensions 48.

The length of the plunger 10 measured from the front of the bosses 76 to the rear face on the trailing disk 66 is about the same as the length of the plunger cavity 20 measured from the grounding disk 12 to back wall out of which the central bore 16 opens (FIG. 5). Hence, when the plunger 10 is in the cavity 20, the trailing disk 66 will be against the back wall of the cavity 20, while the bosses 76 will be against the grounding disk 12. The plunger 10 therefore does not move backwardly or forwardly. When so disposed, the short pin extensions 48 lie entirely within the bores 72 of the leading dielectric disk 64 and do not touch the contact plates 68. The long pin extensions 48, on the other hand, project completely through the bores 72 in the leading disk 64, as well as through the aligned apertures 84 in contact plates 68. The long pin extensions 48 terminate in the bore 80 of the trailing disks 66. Where the long pin extensions 48 have dielectric collars 56, the contact plates 68 grip those pin extensions 48 along the metal surfaces of their cores 52, thereby establishing electrical contact with the pin extensions 48.

Electrical power is normally supplied to the switch A through the long pin extensions 48 that are solid metal throughout. Thus, the contact plate 68 through which a long pin extension 48 projects will conduct the electrical energy to the long pin extension 48 having the dielectric collar 56.

As previously noted, when the plunger 10 is in its initial position (FIG. 5), wherein the bosses 76 project forwardly from its front disk 64, the switch A conducts electrical current from the long pin extensions 48 that are solid metal throughout to the long pin extensions 48 that have the dielectric collars 56 around them, this being by reason of the contact plates 68 gripping the latter pin extensions 48 around their metal cores. In short, the plates 68 complete the circuits between the two types of long pin extensions 48. The short pin extensions, being ahead of the contact plates 68, are electrically isolated from them and therefore are dead from an electrical standpoint. However, when the pyrotechnic cartridge is detonated, the switch A changes condition, energizing the short pin extensions 48 and de-energizing the long pin extensions 48 having the dielectric collars 56 about them.

More specifically, when the pyrotechnic cartridge is detonated, it elevates the pressure within the explosive port 32 of the end fitting 4, and this increase in pressure is transmitted to the pressure cylinder 18 of the switch body 2 through the small orifice 34. The pressure drives the piston 8 forwardly within the pressure cylinder 18 (FIG. 6), and of course the pilot 26, being a part of the piston 8, likewise moves. Indeed, the pilot 26 bears against the trailing disk 66 on the plunger 10 and urges the entire plunger 10 forwardly toward the connector 6. The force is great enough to fracture the leading disk 64 at its regions of weakness 78, and as a consequence, the entire plunger 10, with the exception of the bosses 76, moves forwardly and bottoms out against the grounding disk 12 at the back face of the connector 6. Thus, the plunger 10 assumes a displaced position. The dislodged bosses 76 are accommodated in the axial grooves 74 with which they align. Since the bosses 76 are located at 180° with respect to each other and are of the same size, the regions of weakness 78 fracture simultaneously. Thus, the plunger 10 does not skew, but instead moves through the cavity exactly parallel to the axis X.

Figure 9:
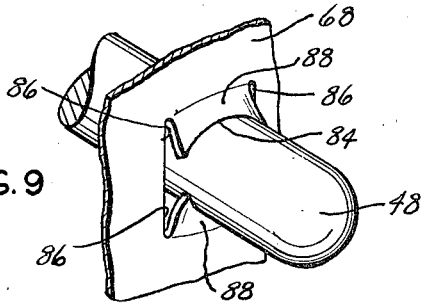
FIG. 9 is a fragmentary perspective view showing one of the solid pin extensions extended through the aperture in the contact plate with which it aligns.

As the plunger 10 changes position, the contact plates 68 at the apertures 84 therein move along the various pin extensions 48 that project from the connector 6. In particular, the contact plates 48 move along the long pin extensions 48 that are solid metal throughout, and since these pin extensions conduct the power into the switch A, the contact plates 68 associated with them remain energized (FIG. 9). The contact plates 68 further move over the long pin extensions 48 having the dielectric collars 56 about them and in so doing move from the metal cores 52 of those extensions 48 onto the dielectric collars 56 (FIG. 10). Thus, the long pin extensions 48 with the dielectric collars 56 become dead, for the dielectric collars 56 will not conduct electric current to the cores 52 of those extensions 48. The movement of the plunger 10 is sufficient to bring the contact plates 68 over the short pin extensions 48 so that the short pin extensions 48 become energized (FIG. 6). In other words, the contact plates 68 conduct current from the long pin extensions 48 that are solid metal throughout to the short pin extensions 48 which are also solid metal throughout.

At each pin extension 48 the tabs 88 at the aperture 84 for that extension 48 are slightly oblique to the axes of the pin extension 48, and as a consequence bite into the surfaces of the pin extension 48 at two locations (FIGS. 9 and 10). Where the bite is along a metal surface of the extension 48, excellent electrical contact of a redundant nature is established. Moreover, the bite prevents the plunger 10 from moving back to its initial position, even when the switch A is subjected to the severest of impacts. Furthermore, as the switch A changes condition little, if any, electrical fluctuation occurs. Indeed, the switch A changes condition with less than 20 microseconds of electrical chatter.

The switch A contains no solder joints, and accordingly is quite easy to assemble.

The switch A which has been disclosed in detail is of the double-pole throw configuration, and this configuration requires six pin extensions 48, aside from the extension 48 projecting from the ground pin 42, and two contact plates 68, with the plates 68 being electrically isolated from each other. Moreover, each plate 68 is associated with one long pin extension 48 that is solid metal throughout, one long pin extension 48 that has a dielectric collar 56 about it, and one short pin extension 48.

It is possible to provide other switch configurations by varying the number of pins 42 and pin extensions 48, the type of pin extension 48, and the number and configuration of the contact plates 68. A wide variety of switch configurations are available. Also, the switch A may be actuated by something other than a pyrotechnic cartridge. For example, a high pressure air line may be connected with the threaded port 32 of the end fitting 4, so that when high pressure air is directed to the fitting 4, the switch A will change condition. Similarly, a hydraulic line may be employed. Indeed, the fitting 4 may be adapted to accommodate a plunger that is shifted mechanically, perhaps by a solenoid coil.

This invention is intended to cover all changes and modifications of the example of the invention herein chosen for purposes of the disclosure which do not constitute departures from the spirit and scope of the invention.

What is claimed is:

1. An electrical switch comprising: a body, a plurality of parallel pins mounted on the body, the pins being electrically conductive; a dielectric member mounted on the body and containing holes with which the pins align, the dielectric member and the pins being arranged such on the body that the relative positions of the dielectric member and the pins can be changed from a first position to a second position along the axis of the pins; and an electrically conductive contact plate mounted on the dielectric member and having apertures that align with the holes in the dielectric member, the apertures being configured to, in at least one of the positions, receive the pins while gripping the pins tightly along their edges, so as to change the condition of an electrical circuit to which the pins are connected.

2. A switch according to claim 1 wherein the pins are in the holes of the dielectric member in both of the relative positions.

3. A switch according to claim 1 wherein the pins are mounted in a fixed position on the body and the dielectric member is capable of moving within the body to change the condition of the switch.

4. A switch according to claim 3 wherein the body contains a cavity in which the dielectric member is disposed, the dielectric member having bosses which are attached thereto at regions of weakness, the bosses being against one end of the cavity when the dielectric member is in its first position, the dielectric member being adapted to fracture along the regions of weakness when a properly oriented force of sufficient magnitude is applied to the dielectric member so as to allow the dielectric member to shift to the second position under the influence of the force.

5. A switch according to claim 3 wherein at least one of the pins projects through the contact plate when the dielectric member is in its first position, and all of the pins project through the contact plate when the dielectric member is in its second position.

6. A switch according to claim 5 wherein at least one of the pins that projects through the contact plate when the dielectric member is in its first position has a metal core and a dielectric collar around the core intermediate the ends of the pin, the collar having substantially the same outside diameter as the portions of the core beyond each end of it so that the pin has a generally uniform diameter; and wherein the contact plate grips the core in one of the positions for the dielectric member and grips the collar in the other of the positions for the dielectric member.

7. A switch according to claim 3 wherein the dielectric member comprises leading and trailing disks formed from a dielectric material with both disks having the holes in them, and the contact plates is interposed between the two disks.

8. A switch according to claim 1 wherein the apertures in the contact plate are smaller in diameter than the pins with which they align, and the contact plate further contains slots which intersect the apertures so as to in effect divide the area around the apertures into tabs which flex and enable the apertures to enlarge and accommodate the pins.

9. An electrical switch comprising: a body containing a plunger cavity provided with a side wall that is parallel to the axis of the cavity; a closure member extended across one end of the cavity; electrically conductive pins mounted on the closure member and projecting into the cavity parallel to the axis of the cavity; and a plunger positioned in the cavity loose enough to shift along the axis of the cavity from a first position to a second position when not otherwise restrained, the plunger being formed from a dielectric material and having holes in which the electrically conductive pins are received, the plunger also including an electrically conductive contact plate having apertures that align with the holes, the apertures being configured to at least in one of the positions receive and tightly grip the pins.

10. A switch according to claim 9 wherein the pins project beyond the closure member in the opposite direction from the plunger cavity and form part of a pin-type electrical connector.

11. A switch according to claim 9 wherein at least one of the pins projects through the contact plate of the plunger in both positions of the plunger.

12. A switch according to claim 11 wherein at least one of the pins is ahead of the contact plate when the plunger is in its first position, but is gripped by the contact plate when the plunger is in its second position.

13. A switch according to claim 11 wherein one of the pins projects through the contact plate in both positions of the plunger and has a metal core and a dielectric collar around the core with the collar having the same outside diameter as the exposed portion of the core so that the diameter of that portion of the pin that is within the cavity is substantially uniform through the cavity, the contact plate being around the exposed portion of the core in one position for the plunger and around the dielectric collar in the other position of the plunger.

14. A switch according to claim 9 wherein the plunger includes two dielectric disks which are attached firmly together, with the contact plate interposed between them.

15. A switch according to claim 9 and further comprising means for holding the plunger in the first position, but being capable of allowing the plunger to move to the second position when sufficient force is applied to the plunger.

16. A switch according to claim 15 wherein the means for holding the plunger in the first position comprises bosses attached to the plunger along regions of weakness and projected axially therefrom toward the closure member, the plunger being adapted to fracture along the regions of weakness when a properly oriented axially directed force of sufficient magnitude is applied to the plunger, the plunger further having a void opening out of its periphery for accommodating the bosses after they are dislodged from the plunger, whereby the plunger will shift toward the closure member under the influence of the force.

* * * * *